US006286567B1

(12) United States Patent
Runft

(10) Patent No.: US 6,286,567 B1
(45) Date of Patent: Sep. 11, 2001

(54) APPARATUS FOR VOLUMETRIC METERING OF SMALL QUANTITIES OF PRODUCT AND DISPENSING THEM INTO CONTAINERS

(75) Inventor: Werner Runft, Winnenden (DE)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 09/509,780

(22) PCT Filed: Jun. 16, 1998

(86) PCT No.: PCT/DE98/01627

§ 371 Date: Jun. 5, 2000

§ 102(e) Date: Jun. 5, 2000

(87) PCT Pub. No.: WO99/16404

PCT Pub. Date: Apr. 8, 1999

(30) Foreign Application Priority Data

Sep. 30, 1997 (DE) ..... 197 43 088

(51) Int. Cl.[7] ..... B05B 1/04

(52) U.S. Cl. ..... 141/145; 141/178; 141/238; 141/242

(58) Field of Search ..... 141/12, 67, 73, 141/145, 178, 238, 242, 280

(56) References Cited

U.S. PATENT DOCUMENTS

| | | | | |
|---|---|---|---|---|
| 2,646,912 | * | 7/1953 | Reveno | 53/436 |
| 2,888,962 | * | 6/1959 | Ammon | 141/143 |
| 4,884,602 | * | 12/1989 | Yamamoto et al. | 141/242 |
| 5,287,897 | * | 2/1994 | Ganberini | 141/130 |
| 5,348,062 | * | 9/1994 | Hartzell et al. | 141/186 |

* cited by examiner

*Primary Examiner*—Gregory L. Huson
*Assistant Examiner*—Peter de Vore
(74) *Attorney, Agent, or Firm*—Ronald E. Greigg; Edwin E. Greigg

(57) ABSTRACT

An apparatus for volumetric metering of small quantities of a product and dispensing them into containers (a) has a metering disk that revolves around a vertical axis and has metering chambers embodied as apertures disposed in groups on a pitch circle. To close the lower opening of the metering chambers, pushers with apertures are displaceably supported on the underside of the metering disk; in the filling position, they close the metering chambers, and in the evacuation position they open them. The pushers are pulled into the filling position by a spring and are pressed into the evacuation position by a controlled stop.

8 Claims, 2 Drawing Sheets

FIG. 2
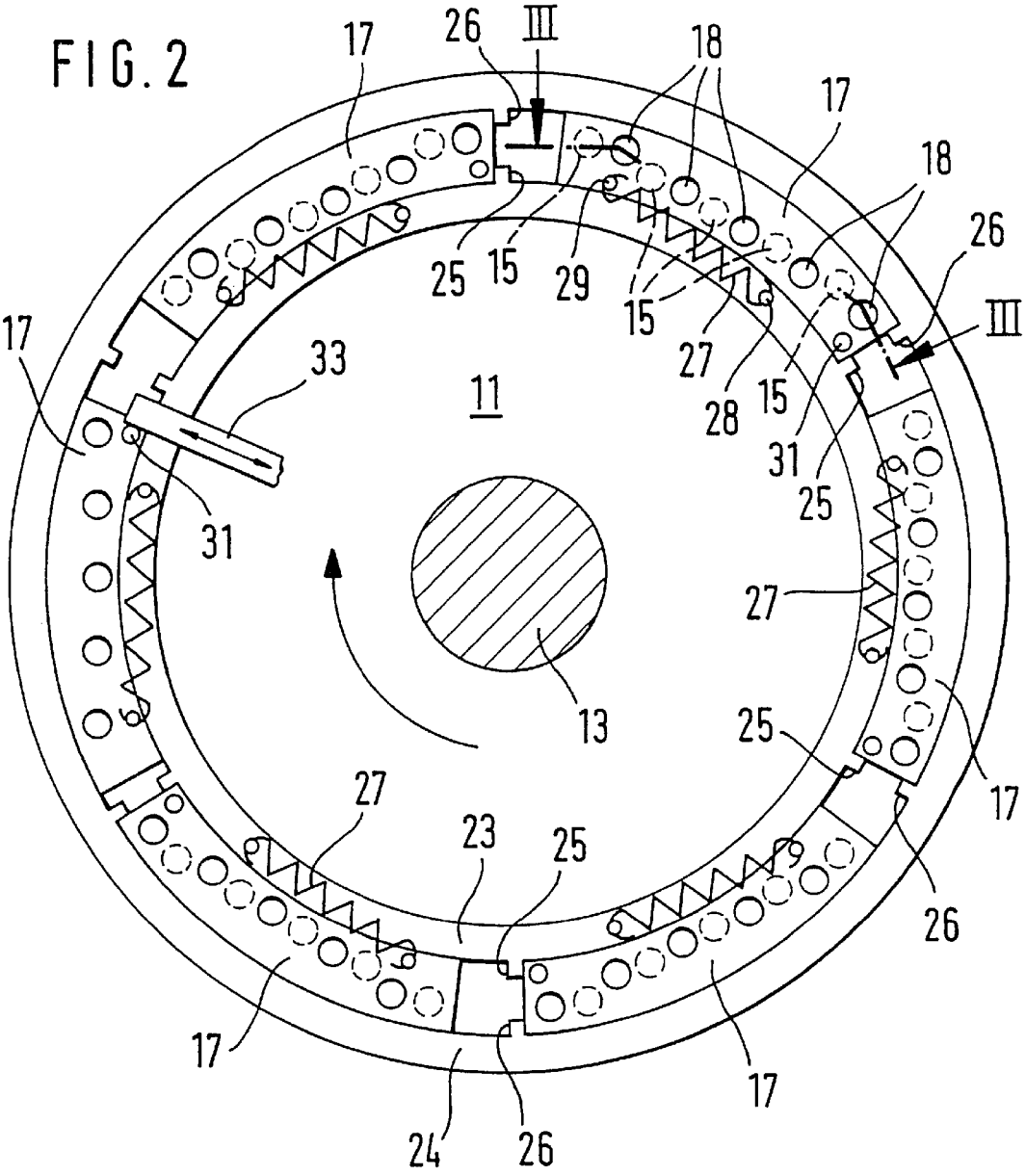
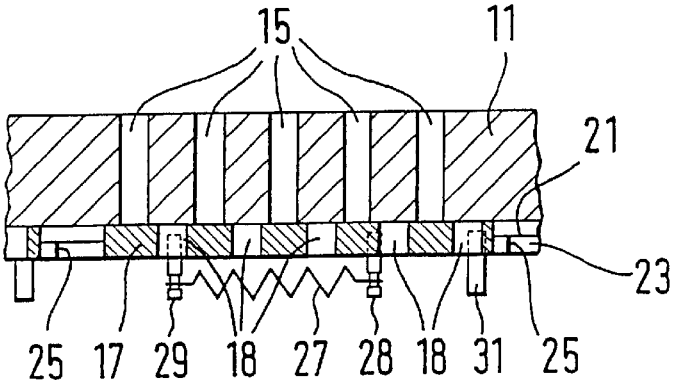
FIG. 3

APPARATUS FOR VOLUMETRIC METERING OF SMALL QUANTITIES OF PRODUCT AND DISPENSING THEM INTO CONTAINERS

PRIOR ART

The invention is based on an apparatus for volumetric metering of small quantities of product and dispensing them into containers. In a known apparatus of this type, the product to be dispensed, such as medicine powder, granulate or similar bulk product, is packed into the narrow metering chambers, which are open on the bottom, with punches, so that the product is held together in the form of a compact formation so the product can be transported to the evacuation station. However, a part of the product crumbles off on the underside, reducing the dose and soiling the apparatus as operation continues.

ADVANTAGES OF THE INVENTION

The apparatus according to the invention has the advantage that each of the metered quantities of a product have the same volume. Since a compact is not formed, less heat in a quantity of the product is generated, which is especially essential in heat-sensitive medications. Sticky products can also be processed with the apparatus of the invention.

By means of the provisions recited herein, advantageous refinements of and improvements to the metering apparatus defined are possible.

BRIEF DESCRIPTION OF THE DRAWINGS

One exemplary embodiment of the invention is shown in the drawings and will be described in further detail below.

FIG. 2 shows the metering apparatus of FIG. 1 in a view from below; and

FIG. 3 shows a fragmentary cross section of the metering apparatus in the plane III—III of FIG. 2.

DESCRIPTION OF THE EXEMPLARY EMBODIMENT

Figure 1:
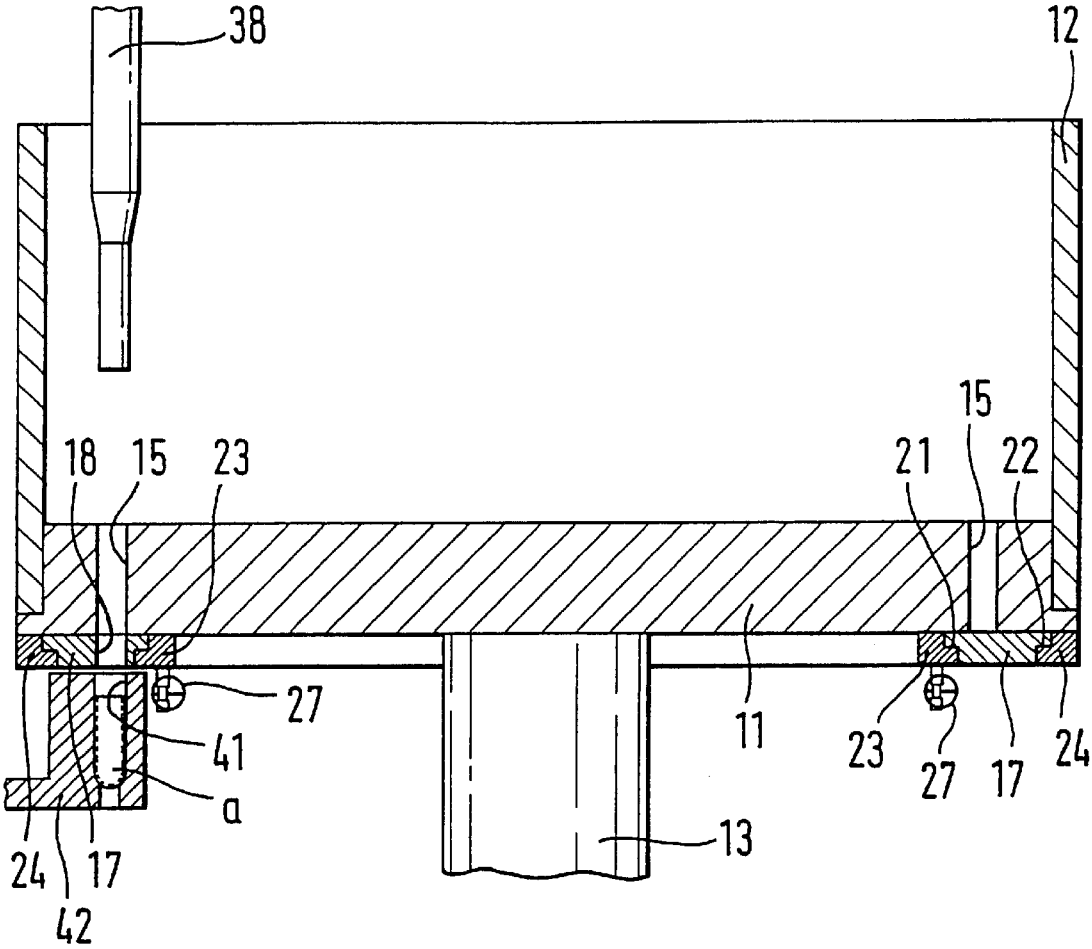
FIG. 1 shows a metering apparatus in cross section.

The metering apparatus shown is used in particular to dispense small quantities of a product, such as medicine powder, granulates and similar bulk products and dispensing them, preferably into hard gelatin capsules. A relatively thick metering disk 11, which has an upward-protruding mounting 12, is secured to a vertical shaft 13 and is rotated incrementally by a certain angle each time. The metering disk 11 has groups, for instance six of them, distributed uniformly over a pitch circle, each with five metering chambers 15 embodied as narrow through bores. The lower opening of the metering chambers 15 of each group is closable by means of a pusher 17. Each pusher 17 has apertures 18, coinciding with the disposition of the metering chambers 15 of one group, and these apertures are offset from the metering chambers 15 in the filling position (FIG. 3) and are aligned with them in the evacuation position. The curved pushers 17, which contact the underside of the metering disk 11, are displaceably supported in graduations 21, 22 slidingly on a circular arc between stop protrusions 25, 26 by two bearing rings 23, 24 secured coaxially with the metering disk 11 on the underside of the metering disk. Tension springs 27, which are suspended by one end on a pin 28 on the slides 17 and on the other on a pin 29 on the inner bearing ring 23, pull the pushers 17 into the closing position, in which they block off the lower opening of the metering chambers 15 (FIG. 3). For opening the metering chambers 15, a stop pin 31 protrudes from the underside of each pusher 17; when a group of metering chambers 15 enters the evacuation station, this stop meets a locking bar 33 provided in its path of revolution, so that the applicable pusher 17 is displaced into its evacuation position, in which its apertures 18 are in coincidence with the associated metering chambers 15. Before the metering disk 11 is indexed onward, the locking bar 31 is retracted, so that the applicable pusher 17 is returned to its closing position again by the associated tension spring 27.

The product to be metered and dispensed is placed on the top of the metering disk 11, and from there it is stripped off by fixedly disposed shunts, not shown, in the course of revolution of the metering disk 11 into its metering chambers 15 outside the evacuation region thereof; the pushers 17 are then in their closing position. Before the entrance into the evacuating station, the upper openings of the metering chambers 15 are stripped off by the shunts, so that the product in the metering chambers 15 is flush with the top of the metering disk 11. In the final phase of the entrance of a group of metering chambers 15 to be evacuated into the evacuation or dispensing station, the stop pin 31 of the applicable pusher 17 strikes the locking bar 33 that has been pushed forward, so that the pusher 17 is pressed into its evacuation position. The product in the metering chambers 15 of the respective aforementioned group of metering chambers 15 in the evacuation position is thrust downward into furnished bottom parts a of hard gelatin capsules by a group of tappets 38 that can be moved up and down and dip into the metering chambers 15 to be evacuated. These bottom parts a are seating in receptacles 41 of holders 42 of a closing wheel of the apparatus. The receptacles 41 are oriented in coincidence with the metering chambers 15.

The foregoing relates to a preferred exemplary embodiments of the invention, it being understood that other variants and embodiments thereof are possible within the spirit and scope of the invention, the latter being defined by the appended claims.

What is claimed is:

1. An apparatus for volumetric metering of small quantities of product from a reservoir (12) and dispensing the product into containers (a), comprising a metering disk (11) in a bottom of said reservoir (12) that revolves about a vertical axis (13), said metering disk includes a plurality of metering chambers (15) which are disposed in multiple groups on a pitch circle and are open at the top and closable at the bottom by a pusher (17), one pusher (17) for each group of metering chambers, each of said metering chambers are filled by sweeping in a product above the pusher and evacuated by openings (18) in said pusher at a filling station in congruence with the containers (a), in that one pusher (17) is provided for each metering chamber groups, each pusher (17) is provided with apertures (18), one each for each metering chamber (15) of each group, and each of said pushers (17) is disposed displaceably on an underside of the metering disk (11), in such a way that the apertures (18) are offset from the metering chambers (15) in the filling position; that the pushers (17), beginning at the filling position, are rotated jointly with the metering disk (11) in a direction of an evacuation station; and upon reaching the evacuation station, the pushers (17) are displaced by stop means (31, 33) relative to the metering disk (11), so that the metering chambers (15) and the apertures (18) coincide in the evacuation position.

2. The apparatus according to claim 1, in which the pushers (17) are embodied in curved form and displaceable along an arc and are kept in the closing position by a spring (27).

3. The apparatus according to claim 2, in which the pushers (17) are disposed to slide in circular grooves (21, 22) of the metering disk (11).

4. The apparatus according to claim 3, in which one pusher (17) each upon entering the evacuation station is moved by a movable stop (33) counter to a force of the spring (23) into an evacuation position and is released by the stop again before the metering disk (11) is indexed onward.

5. The apparatus of claim 4, in which fixed stops (25, 26) are disposed in the circular grooves (21, 22), and the pushers (17) are pulled into the closing position against the stops by the springs (27).

6. The apparatus of claim 3, in which fixed stops (25, 26) are disposed in the circular grooves (21, 22), and the pushers (17) are pulled into the closing position against the stops by the springs (27).

7. The apparatus according to claim 2, in which one pusher (17) each upon entering the evacuation station is moved by a movable stop (33) counter to a force of the spring (23) into an evacuation position and is released by the stop again before the metering disk (11) is indexed onward.

8. The apparatus of claim 7, in which fixed stops (25, 26) are disposed in the circular grooves (21, 22), and the pushers (17) are pulled into the closing position against the stops by the springs (27).

* * * * *